United States Patent [19]

Killingsworth

[11] Patent Number: 4,470,222

[45] Date of Patent: Sep. 11, 1984

[54] WINDOW INSULATOR

[75] Inventor: Walter H. Killingsworth, Baton Rouge, La.

[73] Assignee: T. A. Willeby, Ltd., Baton Rouge, La.

[21] Appl. No.: 337,382

[22] Filed: Jan. 6, 1982

[51] Int. Cl.[3] ..... E05D 15/16

[52] U.S. Cl. ..... 49/419; 49/63; 49/460; 49/501; 52/790

[58] Field of Search ..... 49/63, 413, 460, 414, 49/419, 501; 52/789, 790, 202

[56] References Cited

U.S. PATENT DOCUMENTS

| | | | |
|---|---|---|---|
| 2,138,164 | 11/1938 | Haven | 52/790 X |
| 2,456,486 | 12/1948 | Berghoff | 52/202 |
| 2,779,401 | 1/1957 | Bascom | 49/63 X |
| 2,999,279 | 9/1961 | Lauer . | |
| 3,012,293 | 12/1961 | Migneault et al. | 49/413 |
| 3,402,084 | 9/1968 | Jacobi et al. | 52/790 X |
| 3,846,152 | 11/1974 | Flanc | 52/789 X |
| 3,999,345 | 12/1976 | McKelvey | 52/789 X |
| 4,042,004 | 8/1977 | Kwan | 49/413 X |
| 4,081,581 | 3/1978 | Littell, Jr. | 52/789 X |
| 4,083,148 | 4/1978 | Saucier | 49/63 X |
| 4,160,348 | 7/1979 | Chapman et al. | 52/202 |
| 4,180,942 | 1/1980 | Saucier | 49/63 X |
| 4,184,297 | 1/1980 | Casamayor | 52/202 |
| 4,248,018 | 2/1981 | Casamayor | 52/202 X |
| 4,370,826 | 2/1983 | Davidson | 49/63 X |

*Primary Examiner*—Philip C. Kannan

*Attorney, Agent, or Firm*—Reginald F. Roberts, Jr.

[57] ABSTRACT

The present invention provides a window insulator and a frame therefor. The window insulator and frame comprise (a) one or more panels of an insulating material; (b) guides for the panels, including channels in which the panels are free to move; and (c) pressure-contact means for holding the guides in the casing of an existing window. One or more of the panels may consist of a thick layer of expanded polystyrene disposed between two films or sheetings of a substantially transparent (poly)-methyl methacrylate resin, the polystyrene layer partially cut away to provide transparency for the window.

21 Claims, 10 Drawing Figures

FIG. 8
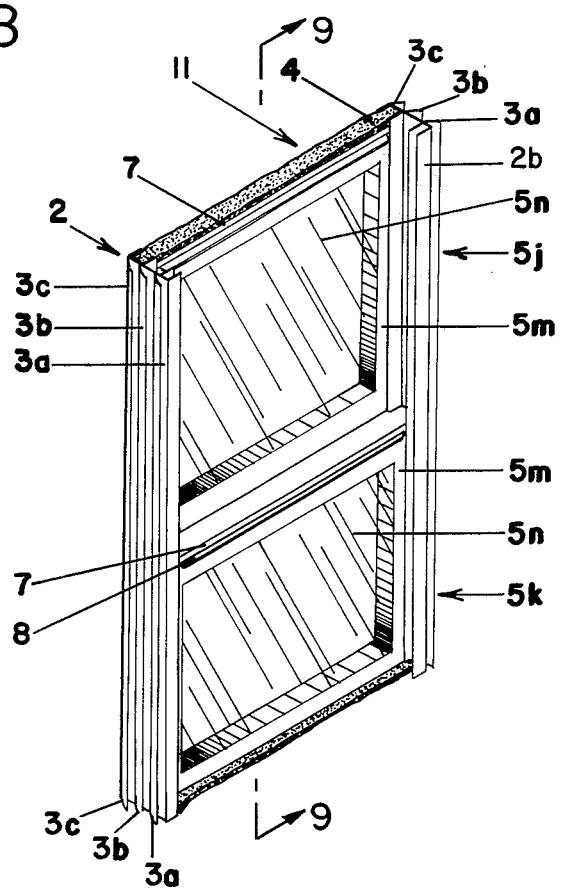
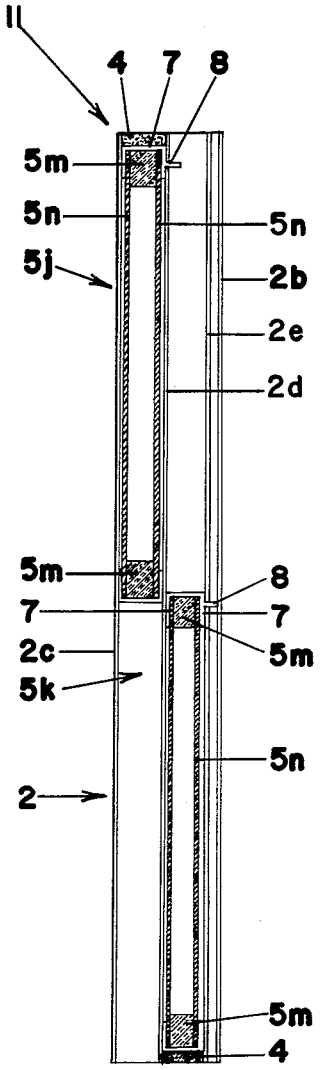
FIG. 9
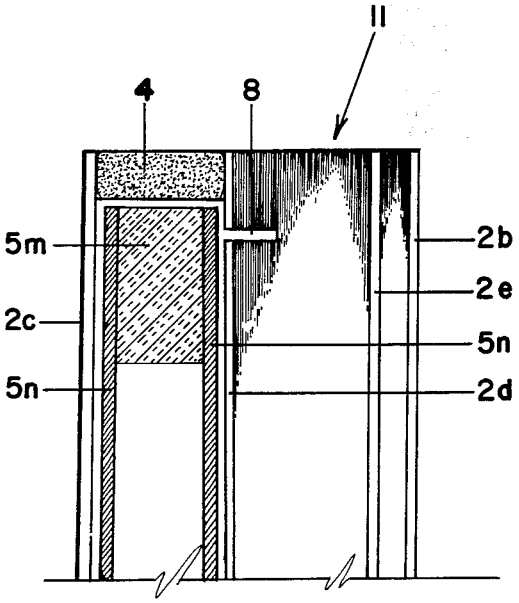
FIG. 10

WINDOW INSULATOR

BACKGROUND OF THE INVENTION

The present invention relates to window insulation. More particularly, the present invention relates to an article for insulating a window against the transmission of thermal energy, and to a method for installing the article.

Window insulation is presently achieved by the installation of storm windows, replacement double-paned windows, sun-reflective screens or adhesive films, and blinds and curtains of various types. Generally, these devices require precise initial measurements, a multiplicity of functional elements, skilled labor, or nuts, bolts, nails, and the like.

SUMMARY

In general, the present invention provides weather insulation for windows and a method for installing same.

A first embodiment of the invention provides a frame for a window insulator, comprising (a) a pair of elongated guides adapted to fit into a window casing, each guide including first, second, and third sides, the second and third sides perpendicular to the first side and extending in the same direction therefrom; and (b) pressure-contact means for holding the guides in the window casing.

A second embodiment of the invention provides a window insulator, comprising (a) a panel of an insulating material, including two pairs of opposite edges; (b) a pair of elongated guides for the panel, each guide including first, second, and third sides, the second and third sides perpendicular to the first side and extending in the same direction therefrom, thereby forming a track for the panel; and (c) pressure-contact means for holding the guides in the window casing.

A third embodiment of the invention provides a window insulator, comprising (a) first and second panels of an insulating material, each panel including two pairs of opposite edges; (b) a pair of elongated guides for the panels, each guide including first, second, and third sides, the second and third sides perpendicular to the first side and extending in the same direction therefrom, each guide further including a first partition between and parallel to the second and third sides, thereby forming a track for each of the panels; and (c) pressure-contact means for holding the guides in the window casing.

BRIEF DESCRIPTION OF THE DRAWINGS

FIG. 8 is an orthographic projection, from the right and from the interior of a structure which includes a window, of a window insulator according to a third embodiment of the present invention.

FIGS. 9 and 10 are vertical cross-sections of the window insulator shown in FIG. 8, taken along the line 9—9.

DESCRIPTION OF THE PREFERRED EMBODIMENTS

Figure 1:
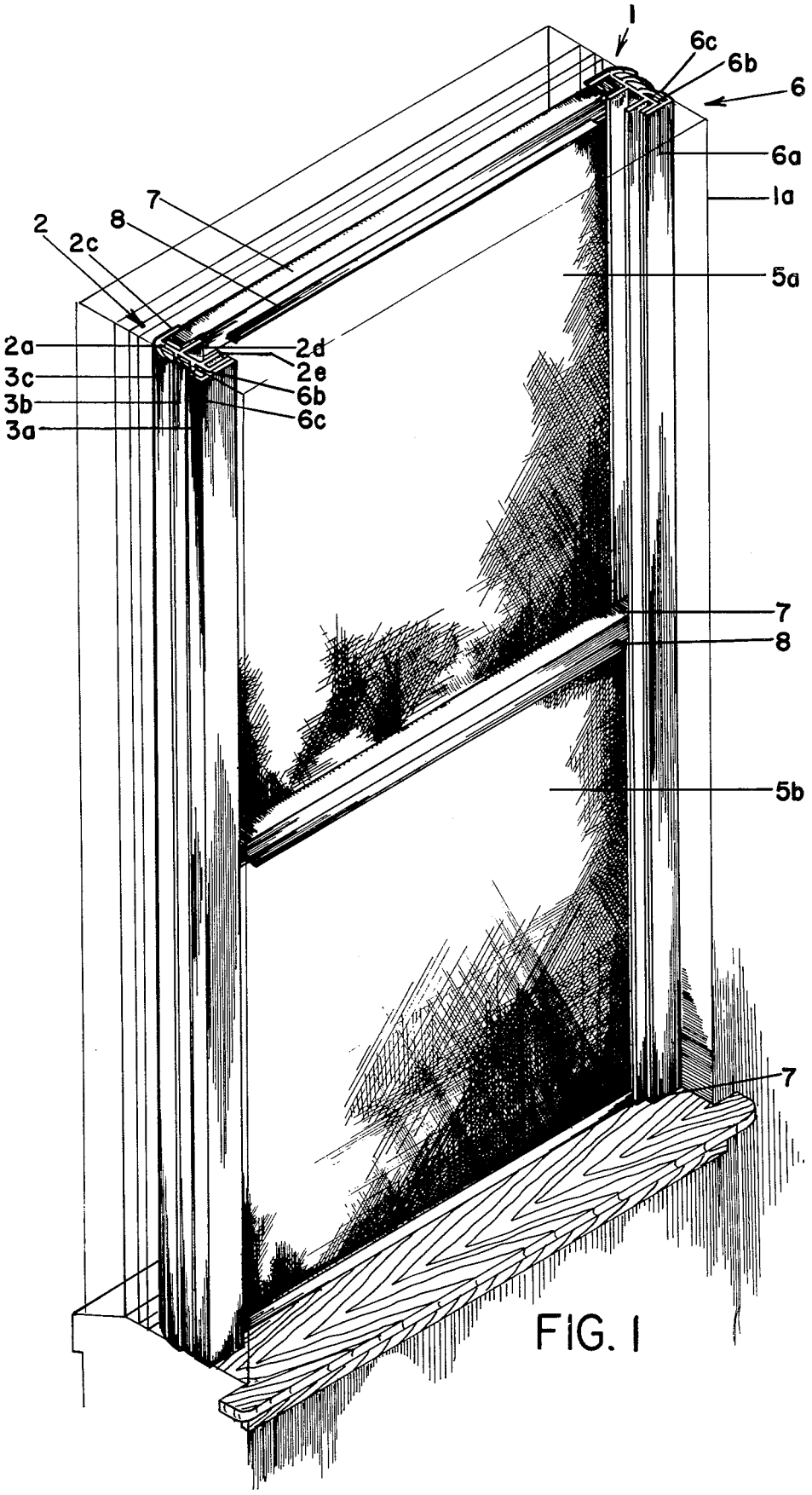
FIG. 1 is an orthographic projection, from the left and from the interior of a structure which includes a window of a window casing and a window insulator according to one embodiment of the present invention.

The following description illustrates the manner in which the principles of the present invention are applied, but is not to be construed as in any sense limiting the scope of the invention.

The pressure-contact means for holding the guides in the window casing may, for example, include a spring. Preferably, however, the pressure-contact means include a plurality of flexible, self-sealing fins fastened to each of the guides, and disposed between the guides and the window casing.

Preferably, the frame for the window insulator further comprises a pair of elongated F-shaped members, each F-shaped member including first, second, and third sides, the second and third sides perpendicular to the first side and extending in the same direction therefrom, the F-shaped members engaging the pair of elongated guides the second and third sides of each F-shaped member parallel to the first side of one of the guides and held by pressure contact between the guide and the window casing, the first side of the F-shaped member parallel to the second and third sides of one of the guides, and adjacent to the inner edge of the guide, thereby providing positional stability for the guides and sealing the space between the guides and the window casing.

Preferably, the frame further includes an elongated U-shaped member, the longitudinal axis of the elongated U-shaped member substantially perpendicular to the longitudinal axes of the elongated guides, and including first, second, and third sides which form a channel for one of the edges of the panel that are substantially perpendicular to the longitudinal axes of the elongated guides, the second and third sides of the U-shaped member substantially parallel to each other and substantially perpendicular to the first side of the U-shaped member and extending in the same direction from the first side, the U-shaped member fastened to and enclosing said edge of said panel.

Even more preferably, the frame further comprises a flange fastened to the U-shaped member, the flange substantially perpendicular to the second and third sides of the U-shaped member, to provide a handle for the U-shaped member.

For the installation of multiple-panel window insulators, each guide further includes a first partition between and parallel to the second and third sides of the guide, to provide a first track for a second panel. The guide may further include a second partition adjacent and parallel to the first partition, to provide a second track for a third panel. The track for the third panel is substantially narrower than the tracks for the first and second panels.

In the preferred embodiments of the present invention, the innermost fin on each guide is disposed between the second and third sides of one of the F-shaped members, thereby further sealing the space between the guides and the window casing. While a wedge or other device may be utilized to seal the space between the guides and the window casing, the preferred method of using the present invention comprises the use of the innermost fin therefor as described hereinabove.

The window insulator may further include a weather seal of an insulating material disposed between the window casing and the nearer edge of each panel, to seal the space therebetween.

The panel of a single-panel window insulator, and the first and second panels of a multiple-panel insulator, are, in the preferred embodiments of the present invention, fabricated from expanded polystyrene, from a layer of expanded polystyrene and a layer of a poly(methyl methacrylate) resin, or from a layer of expanded polystyrene disposed between two layers of a substantially transparent poly(methyl methacrylate) resin. Preferably, a window insulator which includes first and second panels further includes a pair of elongated U-shaped members, the longitudinal axes of the U-shaped members substantially perpendicular to the longitudinal axes of the elongated guides, and including first, second, and third sides which form channels for third edges of the first and second panels, the second and third sides of each U-shaped member substantially parallel to one another and substantially perpendicular to the first side of the U-shaped member and extending in the same direction from the first side, the U-shaped members fastened to and enclosing the third edges of the first and second panels.

The window insulator may further include a third panel, two opposite edges thereof disposed in the track between the second partition and the side of each guide adjacent to the second partition. The third panel is preferably a substantially transparent film or sheeting of a (poly)methyl methacrylate resin. Material suitable as a (poly)methyl methacrylate resin for use in this invention is sold commercially under the tradenames PLEXIGLAS and ACRYLIC GLASS.

The third panel may be provided with a protective cap and handle comparable to those provided for the first and second panels. For this purpose an F-shaped member is beneficially fastened to a third edge of the third panel, the F-shaped element including first, second, and third sides, the second and third sides perpendicular to the first side and extending in the same direction therefrom, the second and third sides of the F-shaped member enclosing the third edge of the third panel, the first side of the F-shaped member providing a handle for moving the third panel.

More specifically, FIG. 1 shows one embodiment of a window insulator 1 according to the present invention. The window insulator 1 is preferably installed from the interior of a structure which includes a window casing 1*a* of an existing window.

The window insulator 1 comprises a pair of vertical guides 2, each of which includes first, second, and third sides 2*a*, 2*b*, and 2*c*, respectively. Self-sealing fins 3*a*, 3*b*, 3*c* are fastened to the guides 2, are disposed between the guides 2 and the window casing 1*a*, provide pressure-contact means for holding the guides 2 in the window casing 1*a*, and seal the space between the guides 2 and the window casing 1*a*.

The first, second, and third sides 2*a*, 2*b*, and 2*c*, in combination with a first partition 2*d*, define a pair of tracks or channels within which two opposite edges of a first panel 5*a* and two opposite edges of a second panel 5*b* are disposed. Each of the remaining edges of the first and second panels 5*a* and 5*b* is enclosed in a U-shaped member 7, which serves as a protective cap for the panel. The caps 7 are preferably tapered at their ends from wide to narrow in a direction away from the center of the window, for close-fitting engagement with the channels in the vertical guides 2. The window insulator 1 further includes a flange 8 fastened to each of the caps 7, to serve as a handle for moving the panel to which the cap 7 is fastened.

The window insulator 1 further comprises a pair of elongated F-shaped members 6 which engage the pair of guides 2, thereby providing positional stability for the guides 2 and to seal the space between the guides 2 and the window casing 1*a*. Each F-shaped member 6 includes first, second, and third sides 6*a*, 6*b*, and 6*c*, respectively. The second and third sides 6*b* and 6*c* are perpendicular to the first side 6*a* and extend in the same direction therefrom. The F-shaped member 6 holds the pair of elongated guides 2 in a position and configuration making the second and third sides 6*b* and 6*c* of each F-shaped member 6 parallel to the first side 2*a* of one of the guides 2. The second and third sides 6*b* and 6*c* of each F-shaped member 6 are held by pressure contact between the guide 2 and the window casing 1*a*. The first side 6*a* of each F-shaped member 6 is parallel to the second and third sides 2*b* and 2*c* of the guide 2 and adjacent to the inner edge of the guide 2.

Figure 2:
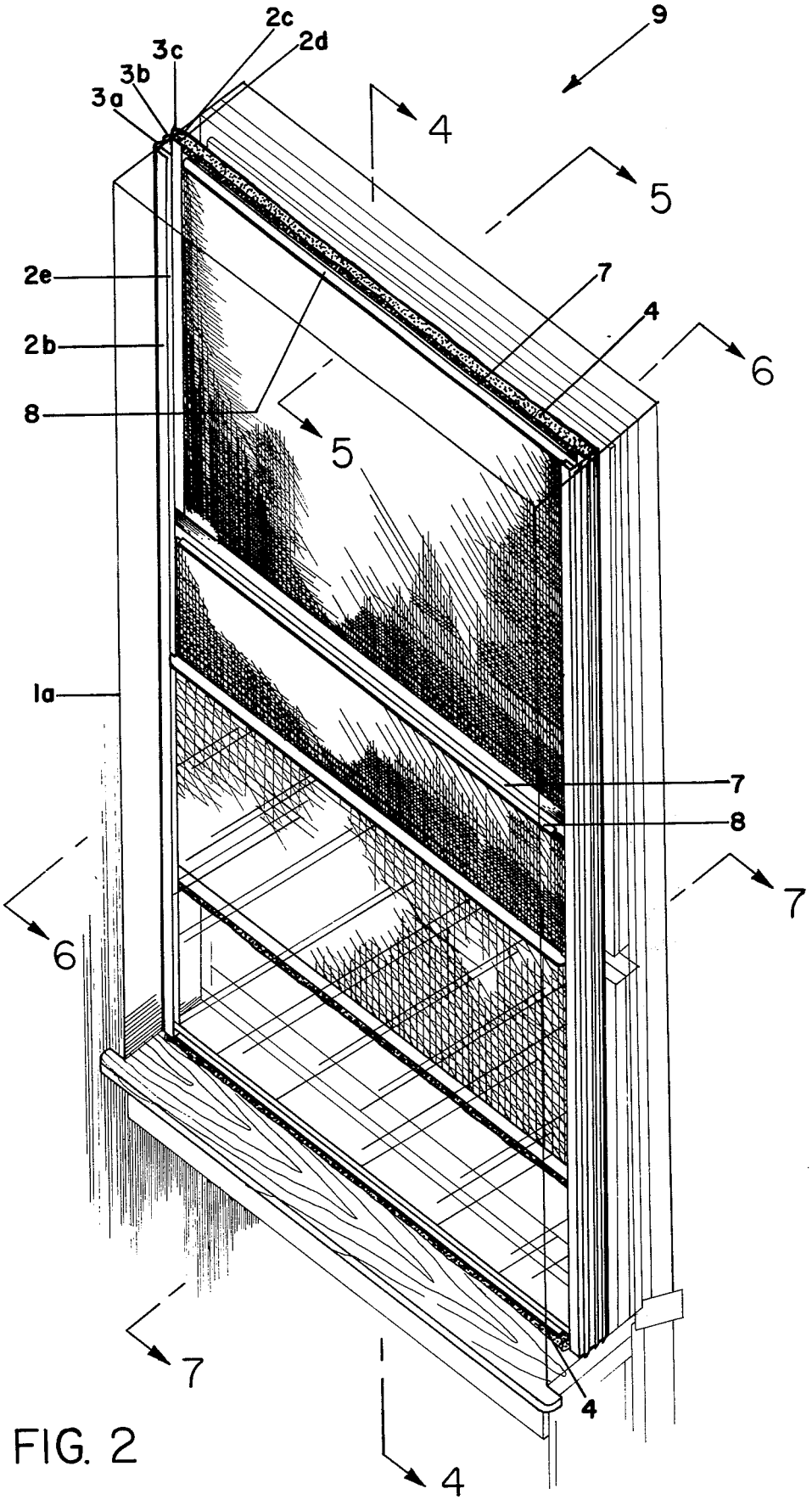
FIG. 2 is an orthographic projection, from the right and from the interior of a structure which includes a window, of a window casing and a window insulator according to another embodiment of the present invention.
Figure 3:
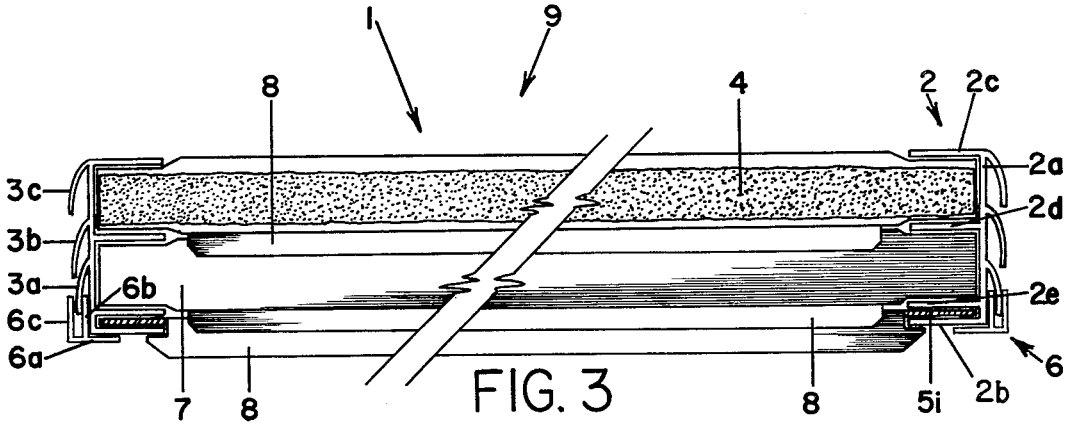
FIG. 3 is a top plan view, with partial cutaway, of the window insulator shown in FIG. 2.
Figure 4:
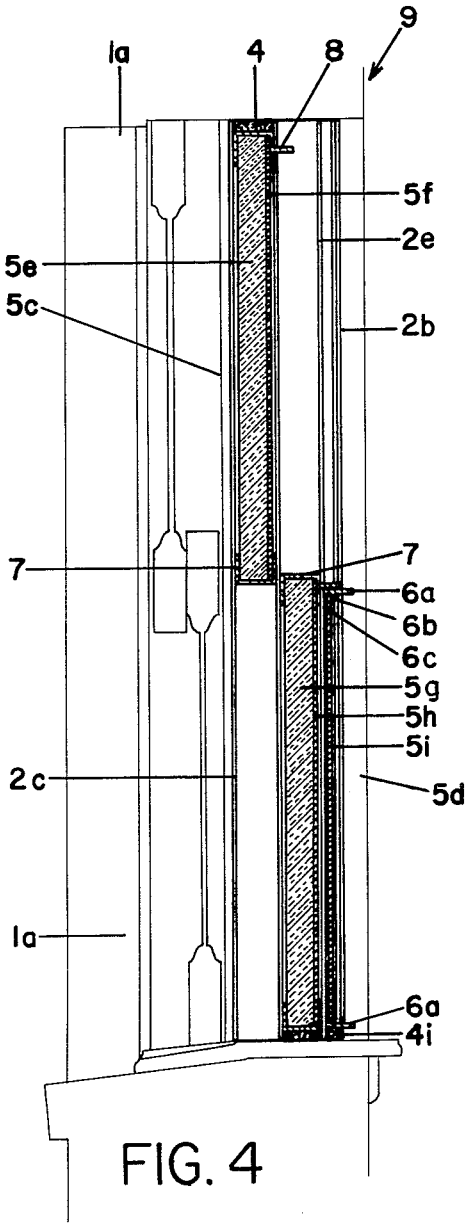
FIG. 4 is a vertical cross-section of the window insulator shown in FIG. 2, taken along the line 4—4.
Figure 5:
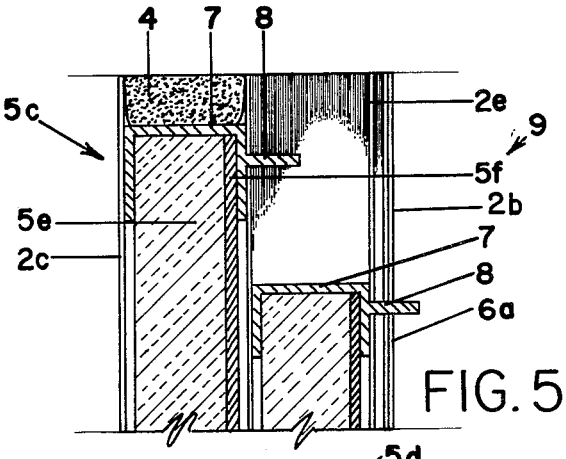
FIG. 5 is a vertical cross-section of the window insulator shown in FIG. 2, taken along the line 5—5.
Figure 6:
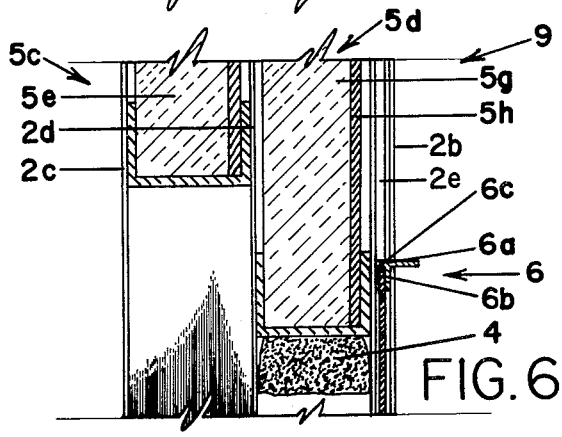
FIG. 6 is a vertical cross-section of the window insulator shown in FIG. 2, taken along the line 6—6.
Figure 7:
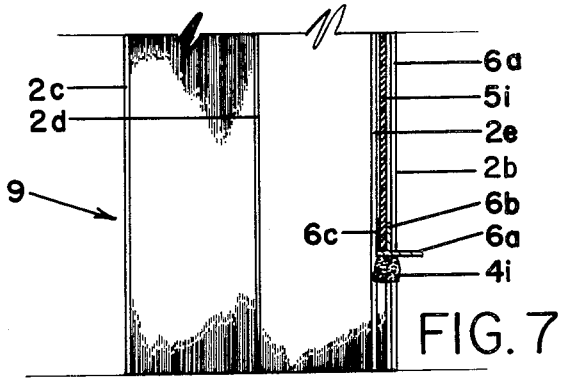
FIG. 7 is a vertical cross-section of the window insulator shown in FIG. 2, taken along the line 7—7.

FIG. 2 shows a second embodiment of a window insulator 9 according to the present invention. The window insulator 9 is likewise installed from the interior of a structure which includes a window casing 1*a* of an existing window. FIG. 3 is a top view of the window insulator 9, with partial cutaway. FIGS. 4, 5, 6, and 7 represent vertical cross-sections of the window insulator 9.

Referring now to FIGS. 4–7, the first panel 5*c* of the window insulator 9 includes an outer layer 5*e* of expanded polystyrene, and an inner layer 5*f* of a (poly)methyl methacrylate resin. The second panel 5*d* likewise includes an outer layer 5*g* of expanded polystyrene, and an inner layer 5*h* of a (poly)methyl methacrylate resin. The thickness of the outer layers 5*e* and 5*g* is considerably greater than that of the inner layers 5*f* and 5*h*.

The window insulator 9 further includes U-shaped caps 7 and flanges 8 for protecting and moving the panels 5*c* and 5*d*.

The window insulator 9 further includes a third panel 5*i* of a poly(methyl methacrylate) resin film or sheeting, one edge of which is enclosed by the sides 6*b* and 6*c* of an elongated F-shaped member 6. The side 6*a* of the F-shaped member 6 serves as a handle for the third panel 5*i*. The window insulator 9 further includes weather seals 4 and 4*i* between the window casing 1*a* and the panels 5*c*, 5*d*, and 5*i*.

FIG. 3 shows the relationship between the guides 2, the fins 3*a*, 3*b*, 3*c*, and the pair of elongated F-shaped member 6. In this drawing the F-shaped member 6 enclosing the third panel 5*i* is omitted, in order more clearly to show the disposition of the panel 5*i*. The innermost fins 3*a* are disposed between the second and third sides 6*b* and 6*c* of the F-shaped members 6, thereby sealing the space between the sides 6*b* and 6*c*. The third panel 5*i* is disposed between a second partition 2*e* and the second side 2*b* of the guide 2.

FIG. 8 is an orthographic projection, from the left and from the interior of a structure which includes a window, of a third embodiment of a window insulator 11 according to the present invention. FIGS. 9 and 10 are vertical cross-sections of the window insulator 11 along the line 9—9 of FIG. 8. The first and second panels 5*j* and 5*k* each comprise a layer 5*m* of expanded polystyrene disposed between two films or sheetings 5*n* of a substantially transparent poly(methyl methacrylate) resin. This third embodiment of the invention beneficially provides a substantial amount of window insulation without appreciable loss of transparency.

While certain representative embodiments and details have been shown for the purpose of illustrating the present invention, it will be apparent to those skilled in the art that various changes and modifications can be made without departing from the spirit and scope of the invention. For example, while vertical guides have been shown for one type of window installation, it will be readily apparent that equivalent horizontal guides may be utilized for another type of installation, in which the panels are moved horizontally rather than vertically.

I claim:

1. A frame for a window insulator, comprising:

(a) a pair of elongated guides to provide a track for a panel, each guide including first, second, and third sides, the second and third sides perpendicular to the first side and extending in the same direction therefrom;

(b) pressure-contact means for holding the guides in the window casing, said pressure-contact means including a plurality of flexible, self-sealing fins fastened to each of the guides, and disposed between the guides and the window casing;

(c) a pair of elongated F-shaped members, each F-shaped member including first, second and third sides, the second and third sides perpendicular to the first side and extending in the same direction therefrom, the F-shaped members engaging the pair of elongated guides, the second and third sides of each F-shaped member parallel to the first side of one of the guides and held by pressure contact between the guide and the window casing, the first side of each F-shaped member parallel to the second and third sides of one of the guides and adjacent to the inner edge of the guide, thereby providing positional stability for the guides and sealing the space between the guides and the window casing.

2. A frame as recited in claim 1, wherein the innermost fin on each guide is disposed between the second and third sides of one of the F-shaped members, thereby further sealing the space between the guides and the window casing.

3. A frame as recited in claim 2, further comprising:

(d) an elongated U-shaped member, the longitudinal axis of the elongated U-shaped member substantially perpendicular to the longitudinal axes of the elongated guides, and including first, second, and third sides which form a channel for one of the edges of the panel that are substantially perpendicular to the longitudinal axes of the elongated guides, the second and third sides of the U-shaped member substantially parallel to each other and substantially perpendicular to the first side of the U-shaped member and extending in the same direction from the first side, the U-shaped member fastened to and enclosing said edge of said panel.

4. A frame as recited in claim 5, further comprising:

(e) a flange fastened to the U-shaped member, the flange substantially perpendicular to the second and third sides of the U-shaped member, to provide a handle for the U-shaped member.

5. A frame as recited in claim 4, wherein each guide further includes a first partition between and parallel to the second and third sides of the guide, to provide a track for a second panel.

6. A frame as recited in claim 5, wherein each guide further includes a second partition adjacent and parallel to the first partition, to provide a track for a third panel.

7. A frame as recited in claim 6, wherein the track for the third panel is substantially narrower than the tracks for the first and second panels.

8. A window insulator, comprising:

(a) a panel of an insulating material, including two pairs of opposite edges;

(b) a pair of elongated guides to provide a track for the panel, each guide including first, second, and third sides, the second and third sides, the second and third sides perpendicular to the first side and extending in the same direction therefrom; and (c) pressure-contact means for holding the guides in the window casing, said pressure-contact means including a plurality of flexible, self-sealing fins fastened to each of the guides and disposed between the guides and the window casing;

(d) a pair of elongated F-shaped members, each F-shaped member including first, second, and third sides, the second and third sides perpendicular to the first side and extending in the same direction therefrom, the F-shaped members engaging the pair of elongated guides, the second and third sides of each F-shaped member parallel to the first side of one of the guides and held by pressure contact between the guide and the window casing, the first side of each F-shaped member parallel to the second and third sides of one of the guides and adjacent to the inner edge of the guide, thereby providing positional stability for the guides and sealing the space between the guides and the window casing.

9. The window insulator of claim 8, wherein the innermost fin fastened to each guide is disposed between the second and third sides of the F-shaped member, thereby further sealing the space between the guides and the window casing.

10. The window insulator of claim 9, further comprising:

(e) an elongated U-shaped member, the longitudinal axis of the elongated U-shaped member substantially perpendicular to the longitudinal axes of the elongated guides, and including first, second, and third sides which form a channel for a third edge of the panel, the second and third sides of the U-shaped member substantially parallel to each other and substantially perpendicular to the first side of the U-shaped member and extending in the same direction from the first side, the U-shaped member fastened to and enclosing the third edge of the panel, to provide a protective cap for the panel.

11. The window insulator of claim 10, further comprising:

(f) a flange fastened to the U-shaped member, the flange substantially perpendicular to the second and third sides of the U-shaped member, to provide a handle for moving the panel.

12. The window insulator of claim 11, wherein the composition of the panel includes expanded polystyrene.

13. A window insulator, comprising:

(a) first and second panels of an insulating material, including two pairs of opposite edges;

(b) a pair of elongated guides to provide a track for each panel each guide including first, second and third sides, the second and third sides perpendicular to the first side and extending in the same direction therefrom, each guide further including a first partition between and parallel to the second and third sides, thereby forming a track for each of the panels;

(c) pressure-contact means for holding the guides in the window casing, said means including a plurality of flexible, self-sealing fins fastened to each of the guides and disposed between the guides and the window casing; and (d) a pair of elongated F-shaped members, each F-shaped member including first, second and third sides perpendicular to the first side and extending in the same direction therefrom, the F-shaped members engaging and holding the pair of elongated guides in a position and configuration making the second and third sides of each F-shaped member parallel to the first side of one of the guides, the second and third sides of each F-shaped member held by pressure contact between the guide and the window casing, the first side of the F-shaped member parallel to the second and third sides of the guide and adjacent to the inner edge of the guide, thereby stabilizing the guides and sealing the space between the guides and the window casing.

14. The window insulator of claim 13, wherein the innermost fin fastened to each guide is disposed between the second and third sides of the F-shaped member, thereby further sealing the space between the guides and the window casing.

15. The window insulator of claim 14, further comprising:

(e) a pair of elongated U-shaped members, the longitudinal axes of the U-shaped members substantially perpendicular to the longitudinal axes of the elongated guides, and including first, second, and third sides which form channels for third edges of the first and second panels, the second and third sides of each U-shaped member substantially parallel to one another and substantially perpendicular to the first side of the U-shaped member and extending in the same direction from the first side, the U-shaped members fastened to and enclosing the third edges of the first and second panels, thereby providing a protective cap for the panels.

16. The window insulator of claim 15, further comprising:

(f) a flange fastened to each of the U-shaped members, the flange substantially perpendicular to the second and third sides of the U-shaped member, to provide a handle for moving the panel to which the U-shaped member is fastened.

17. The window insulator of claim 16, wherein the compositions of the first and second panels include expanded polystyrene.

18. The window insulator of claim 17, wherein each guide further includes a second partition adjacent and parallel to the first partition; to provide a track for a third panel.

19. The window insulator of claim 18, further comprising:

(g) a third panel, two opposite edges thereof disposed in the track between the second partition and the side of each guide adjacent to the second partition.

20. The window insulator of claim 19, wherein the third panel is a film or sheeting of a (poly)methyl methacrylate resin, and the second partition is substantially closer to the second or third side of the guide than to the first partition.

21. The window insulator of claim 20, further comprising:

(h) an F-shaped member fastened to a third edge of the third panel, the F-shaped member including first, second, and third sides, the second and third sides perpendicular to the first side and extending in the same direction therefrom, the second and third sides of the F-shaped member enclosing the third edge of the third panel, the first side of the F-shaped member providing a handle for moving the third panel.

* * * * *